US005365844A

United States Patent [19]

Miyashige

[11] Patent Number: 5,365,844

[45] Date of Patent: Nov. 22, 1994

[54] DEVICE FOR CONTROLLING A WEB IN A PRINTING PRESS

[75] Inventor: Yoshiki Miyashige, Tokyo, Japan

[73] Assignee: Rockwell International Corporation, El Segundo, Calif.

[21] Appl. No.: 99,293

[22] Filed: Jul. 29, 1993

[51] Int. Cl.[5] ..... B41F 13/54

[52] U.S. Cl. ..... 101/228; 226/11; 226/42

[58] Field of Search ..... 101/181, 219, 220, 224, 101/226, 227, 228, 229, DIG. 42; 226/10, 11, 31, 36, 37, 42

[56] References Cited

U.S. PATENT DOCUMENTS

| | | | |
|---|---|---|---|
| 1,427,461 | 9/1922 | Henderson | 101/DIG. 42 |
| 3,724,733 | 4/1973 | Schaffer et al. | 226/42 |
| 3,905,533 | 9/1975 | Corse | 101/228 |
| 4,007,866 | 2/1977 | Traise | 226/31 |
| 4,078,487 | 3/1978 | McComb | 226/11 |
| 4,846,060 | 7/1989 | Proctor | 226/11 |
| 4,852,785 | 8/1989 | Bettendorf et al. | 226/42 |
| 4,896,808 | 1/1990 | Bolza-Schünemann et al. | 226/42 |
| 4,919,049 | 4/1990 | Medermaier et al. | 101/228 |
| 5,024,156 | 6/1991 | Hank et al. | 101/228 |
| 5,269,222 | 12/1993 | Johnson et al. | 101/228 |

FOREIGN PATENT DOCUMENTS

| | | | |
|---|---|---|---|
| 1149282 | 12/1957 | France | 226/31 |
| 2305249 | 9/1973 | Germany | 226/42 |
| 0313247 | 12/1989 | Japan | 226/42 |
| 8601155 | 2/1986 | WIPO | 101/228 |

OTHER PUBLICATIONS

"Measurements and Control of Paper Tension on Rotary Printing Machines", W. Hoheisel, Science & Industry, No. 14, 1979, pp. 29-32.

*Primary Examiner*—Eugene H. Eickholt

*Attorney, Agent, or Firm*—C. B. Patti; H. F. Hamann

[57] ABSTRACT

A device (20) for controlling a web (2) in a printing press (4) having a supply roll (1) of the web (2), a printing drum or roll (4a) of the press (4), a device (12) for detecting a power loss of the press (4), and a device (10 and 10) responsive to the detecting device (12) for controlling the tension of the web (2) in the event of a power loss.

10 Claims, 2 Drawing Sheets

DEVICE FOR CONTROLLING A WEB IN A PRINTING PRESS

CROSS-REFERENCE TO RELATED APPLICATION

The present application claims the priority of Japanese Utility Model application HEI 4-62268 (RGS402A), filed in Japan on Aug. 12, 1992, and incorporated herein by reference.

BACKGROUND OF THE INVENTION

The present invention relates to devices for controlling a web in a printing press.

In the past, printing presses have had a suitable device to control the tension in a web, such as a dancer roll and associated tension detector, in the presence of power supplied to the press. Although such devices may cause sufficient control in the tension of the web under usual conditions, occasionally the press may be subjected to a power loss which renders such a tension control device inoperative and ineffective.

During the sudden power loss, the inertia of the rotating supply roll of the web renders the moving web into an uncontrolled condition, thus causing a possible breakage of the web, and possibly large slack portions of the web which may entangle in the press, thus causing secondary undesirable conditions in the press, which may cause damage to the press. Of course, even in the case of web breakage, when the power is again supplied to the press, the surplus portions of the web must be removed from the press, and the web must be again threaded through the press to continue printing of the web, thus causing inconvenience and loss of time to the operator of the press.

SUMMARY OF THE INVENTION

A principal feature of the present invention is the provision of an improved device for controlling a web in a printing press.

The device of the present invention comprises a supply roll of a paper web, and a printing roll of the press.

A feature of the invention is the provision of means for detecting a power loss of the press.

Another feature of the invention is the provision of means responsive to the detecting means for controlling the tension of the web in the event of the power loss.

Thus, a feature of the invention is that the device maintains control of the tension in the web in the event of the power loss.

Another feature of the invention is that the device minimizes the possibility of breakage of the web in the event of the power loss to the press.

Yet another feature of the invention is that the device thus minimizes the possibility that the operator of the press must remove broken or slack portions of the web in the event of a power loss.

A further feature of the invention is that the device minimizes the possibility that the operator must rethread the web through the press in the event of the power loss to the press.

Still another feature of the invention is that the device minimizes the inconvenience and wasted time associated with a rupture of the web during a power loss or failure of the press.

Another feature of the invention is that the device minimizes the possibility of damage to the press in the event of a power loss to the press.

Further features will become more fully apparent in the following description of the embodiment of the invention, and from the appended claims.

DESCRIPTION OF THE PREFERRED EMBODIMENTS

Figure 1:
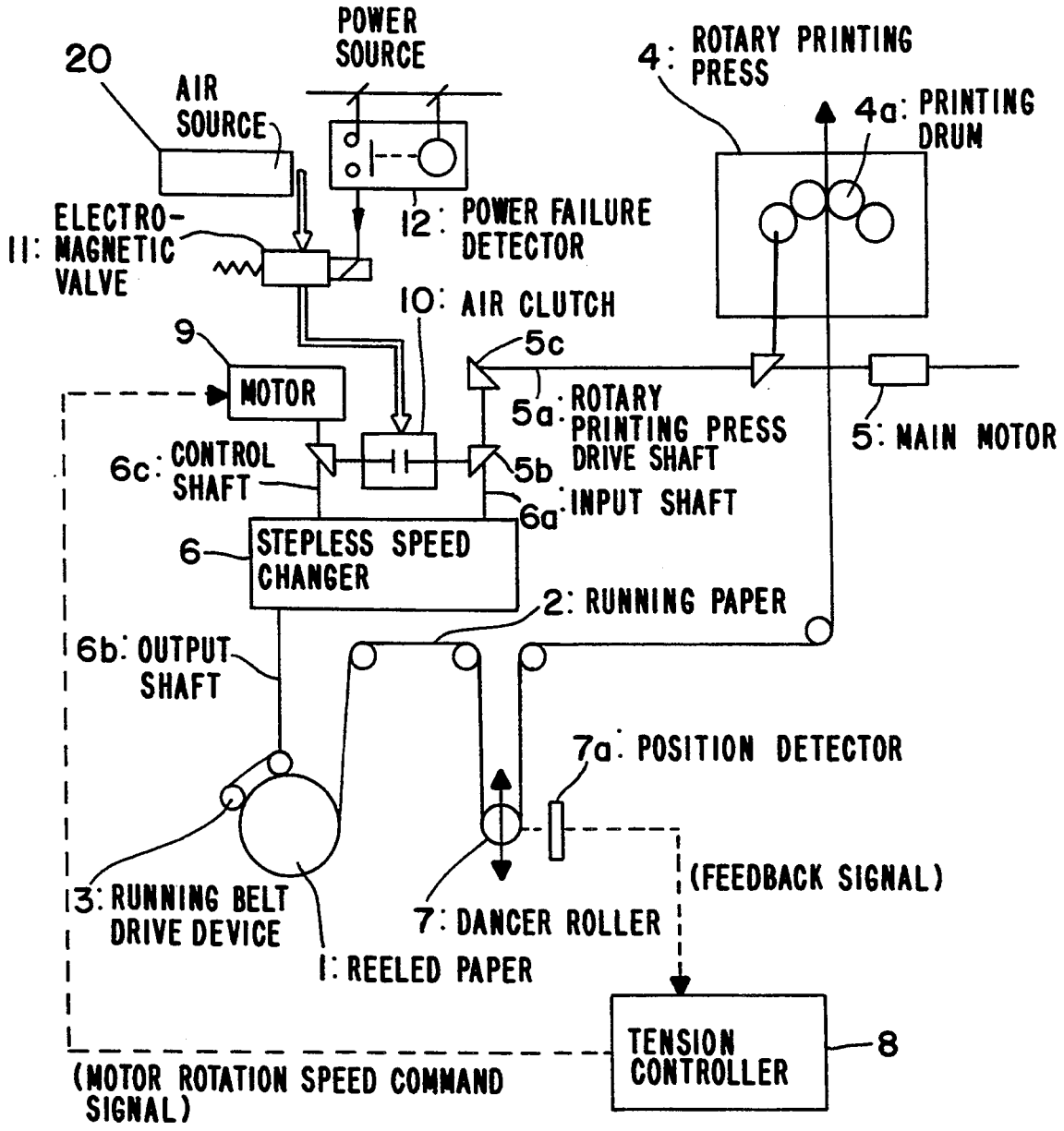
FIG. 1 is a block diagram of a device for controlling a web in a printing press of the present invention.

Referring now to FIG. 1, there is shown a device generally designated 20 for controlling a web 2 in a printing press generally designated 4. As shown, the press 4 has a rotatable supply roll 1 of the paper web 2, and the web 2 is unwound from the roll 1 in order to supply the web 2 to a rotating printing drum 4*a* of the press, and print an image on the web 2. The device 20 has an endless driven belt or belt drive device 3 in order to cause unwinding of the web 2 from the roll 1, and to supply a desired amount of tension to the web 2.

The device 20 has a main motor 5 which drives the printing drum 4*a*, and which has a drive shaft 5*a* connected to the motor 5 in order to also rotationally drive a first pinion gear 5*c* and a second pinion gear 5*b* which is connected to the first pinion gear 5*c*.

The device 20 has a stepless speed changer 6 which transmits the rotation of the drive shaft 5*a* through an input shaft 6*a* to the speed changer 6. The device 20 thus transmits rotation of the main motor 5 to the speed changer 6. The speed changer 6 has an output shaft 6*b* which rotates and drives the belt drive device 3, and a control shaft 6*c* to control the ratio of rotational speed of the output shaft 6*b* with respect to the rotational speed of the input shaft 6*a*.

The press 4 has a dancer roll or roller 7 which moves upwardly and downwardly based upon the tension of the web 2 in the press 4. The press 4 has a position detector 7*a* for the web 2, which converts the position of the roller 7 into a detection signal which is supplied to a tension controller 8. The tension controller 8 controls the rotational speed of an auxiliary motor 9 which rotates and drives the control shaft 6*c* of the speed changer 6 predicated upon the feedback signal detected by the position detector 7*a* and supplied by the tension controller 8.

The device 20 has an air-driven clutch 10 which connects the control shaft 6*c* of the speed changer 6 to the input shaft 6*a* of the speed changer 6. The device 20 also has a suitable valve 11 which activates and deactivates (ON or OFF) the clutch 10, and a power failure detector 12 which detects the presence of a power loss or failure of the press 4.

Under usual conditions, the main motor 5 rotates and drives the printing drum 4*a* of the press 4 in order to pull the web 2 through the press 4, which raises the dancer roll 7. The tension controller 8 compares the feedback signal coming from the position detector 7*a* associated with the dancing roller 7 against a preset standard position signal or data, and then outputs a motor rotational speed command signal to the motor 9 which drives the control shaft 6c of the speed changer 6 to bring the position of the dancer roller 7 closer to the standard position while controlling the tension in the wed 2.

The valve 11 is not magnetically activated under usual conditions, and thus the clutch 10 is not triggered and the input shaft 6a of the speed changer 6 is not connected to the control shaft 6c at this time. As the control shaft 6c of the stepless speed changer 6 is rotated and driven by the motor 9, the output shaft 6b of the speed changer 6 rotates at a speed which is proportional, at a specified ratio, to that of the input shaft 6a of the speed changer 6 which receives the input as the rotational speed of the drive shaft 5a of the press 4.

Figure 2:
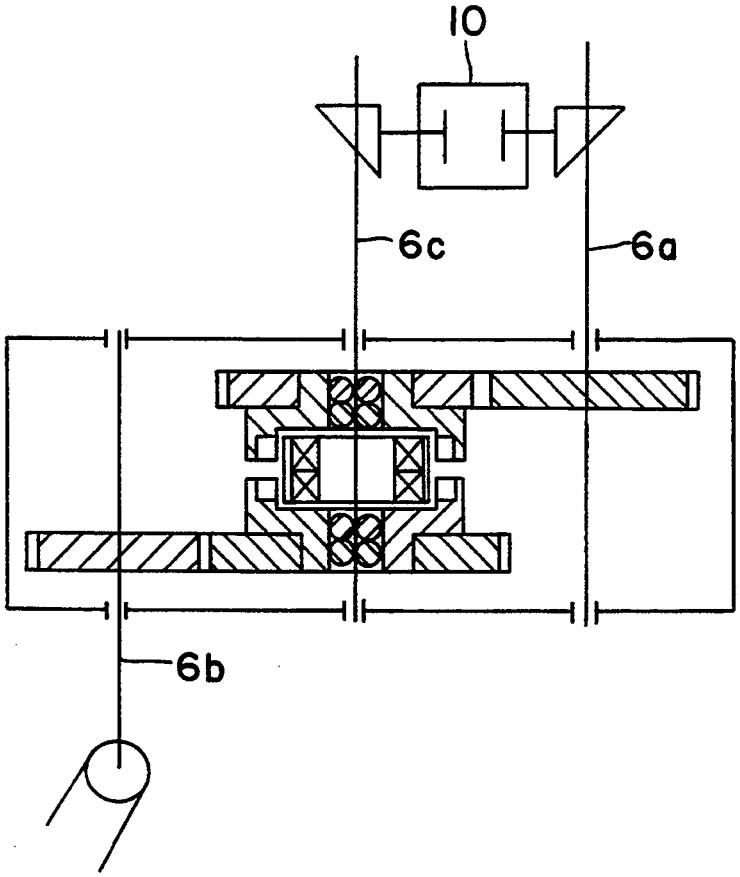
FIG. 2 is a sectional view of a speed changer in the device of FIG. 1.

The speed changer 6 is shown in greater detail in FIG. 2, in which like reference numerals designate like parts. As shown, the speed changer 6 has three mechanisms comprising the input shaft 6a side, output shaft 6b side, and control shaft 6c side. The speed changer may be of a suitable type, such as the speed changer sold under the trademark HARMONIC DRIVE, manufactured by Harmonic Drive System K.K. In the drive, a rigid ring is utilized on the input 6a side, with spline-like teeth in its inner circumference. The output 6b side is shaped like a thin cup constructed from an elastic steel member, with spline-like teeth being etched on the outer circumference of the open side of the cup. The control shaft 6c side is constructed from an oval plug and ball bearings fitted on its outer circumference, with the entire control shaft side being oval shaped.

The relationship between the rotation of the input shaft 6a, the output shaft 6b, and the control shaft 6c in the speed changer 6 may be expressed by the following equation (1):

$$ND=NS\times(R+1)/R-(NW/R), \quad (1)$$

where,

ND: Rotation number of output shaft 6b,

NS: Rotation number of input shaft 6a,

NW: Rotation number of control shaft 6c, and

R : Speed ratio.

The output shaft 6b of the speed changer 6 drives the running belt device 3. With this drive, the paper or supply roll 1 rotates and unreels into the running paper or web 2. With the advancement of the running web 2 which is pulled off the roll 1 by the printing drum 4a of the rotary printing press 4, the dancer roller 7 descends when the amount of unreeling of the supply roll 1 becomes greater. The position of the dancer roller 7 is detected by the position detector 7a mounted near the dancer roller 7, which results in a feedback signal to the tension controller 8.

The tension controller 8 compares the feedback signal against a preset standard data position, and outputs a motor rotation speed command signal to the motor 9 which drives the control shaft 6c of the speed changer 6, and brings the position of the paper web 2 to the standard position. Based upon the data of the motor rotation command signal, the rotational speed of the belt drive 3, i.e., the rotational speed of the output shaft 6b, causes the dancer roller 7 to assume its standard position. Thus, the position of the dancer roller 7 and the tension of the web 2 is maintained at a constant level during presence of power to the printing press 4.

In the event of a power failure or loss to the press 4, the power failure detector 12 is triggered resulting in actuation of the valve 11 which in turn actuates the clutch 10. In this configuration, the control shaft 6c is connected to the input shaft 6a of the speed changer 6 through the pinion gear 5b which is connected to the drive shaft 5a by the clutch 10. As a result, the rotation number of the output shaft 6c of the speed changer is mechanically controlled in proportion to the speed of the rotary printing press 4.

Since the rotation number of the belt device 3 connected to the output shaft 6c is controlled proportionally by a certain ratio to the speed of the rotary press 4, the device 20 suppresses the inertial force of the paper roll 1 during the power loss, and causes a tension to the running web 2 which is unreeled from the paper roll 1. Thus, the device 20 prevents breakage of the paper web 2 which otherwise may be caused by relaxation of the running web 2 in the event of a loss of power to the printing press 4.

EXAMPLE

An example of the calculations which determines the rotation number of the output shaft 6b and the rotation number of the belt device 3 which is needed to create tension in the running web 2 is set forth below.

In order to simplify the calculations, the following conditions are imposed on the device 20.

(a) The diameter ($D_1$) of the printing drum 4a is equal to the diameter ($D_0$) of the belt device 3;

(b) The rotation number ($N_1$) of the printing drum 4a is equal to the rotation number ($N_S$) of the input shaft 6a of the stepless speed changer 6; and (c) The speed ratio (R) of the speed changer 6 is equal to 101.

If the circumferential velocity of the running belt device 3 is assumed to be 99% of the circumferential velocity of the printing drum 4a (x=99%), the following results can be obtained from condition (a).

(d) The rotation number of the running belt device 3 is equal to 99%×rotation number of the printing drum 4a ($N_1$); and (e) The rotation number ($N_D$) of the output shaft 6b of the speed changer 6 is equal to 0.99×rotation number ($N_1$) of the printing drum 4a.

Figure 3:
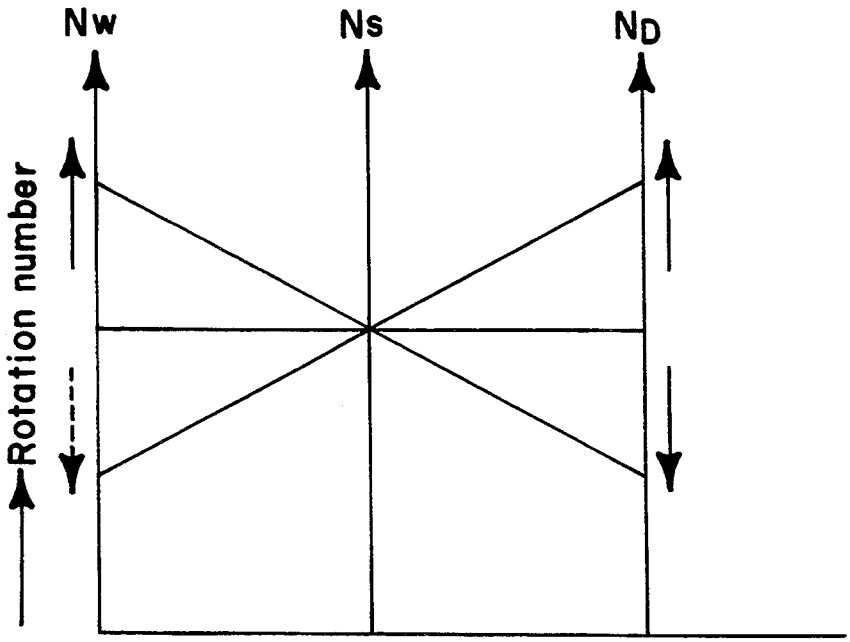
FIG. 3 is a graph illustrating the relationship between an input shaft, a control shaft, and an output shaft of the speed changer of FIG. 2.

FIG. 3 is a graph which illustrates the relationship between the rotation numbers of the input shaft 6a, output shaft 6b, and the control shaft 6c of the speed changer, based upon the conditions (a)–(e).

Thus, the rotation number ($N_D$) of the output shaft 6b may be expressed as follows.

$$N_D=N_S+(N_S-N_W)/\mathrm{R}, \text{ and} \quad (2)$$

$$N_D/N_S=1+(1-N_W/N_S)/R. \quad (3)$$

Based upon the above relationships, the following expression may be formed:

$$N_D/N_1=N_D/N_S=X=0.99. \quad (4)$$

If R=101, then equation (3) can be expressed as follows:

$$N_W/N_S=1(X-1)\times R=2.01. \quad (5)$$

Thus, the rotation number ($N_W$) of the control shaft 6c will remain proportional to the rotation number ($N_S$) of the input shaft 6a.

Thus, by presetting the ratio of the rotational speed ($N_W$) of the control shaft 6c to the rotational speed ($N_S$)

of the input shaft *6a*, the rotational speed of the output shaft *6b* of the speed changer 6 can be determined, i.e., the rotational speed of the belt device 3. Thus, with the rotational speed of the output shaft *6b* of the speed changer, it is possible to bestow sufficient tension to the running web 2 when power to the press has been interrupted.

Thus, the device 20 of the present invention can maintain the speed of the surface of the web 2 in a proportional relationship to the rotational speed of the rotary printing press 4 at a certain ratio when power to the press 4 has been lost, and can bestow a certain tension to the running web 2 which is unreeled from the paper roll 1 in order to suppress the inertial forces of the paper roll 1. The device 20 can maintain tension of the running web 2 when power to the press 4 has failed, thus eliminating breakage of the web 2 and avoiding secondary problems to the press 4, such as stagnation of the paper web 2 caused by breakage of the web 2, and possible damage to the press 4, as well as avoiding inconvenience and lost time to the operator of the press 4.

The foregoing detailed description has been given for clearness of understanding only, and no unnecessary limitations should be understood therefrom, as modifications will be obvious to those skilled in the art.

What is claimed is:

1. A device for controlling a web in a printing press, comprising:

a supply roll of the web;

a printing roll of the press;

means for detecting a power loss of the press; and means responsive to the detecting means for controlling the tension of the web in the event of the power loss, including first means for driving the supply roll, and in which the controlling means controls the speed of the driving means, and including second means for driving the printing roll, and in which the controlling means controls the ratio of the first and second drive means to maintain the tension in the web in the event of the power loss.

2. The device of claim 1 wherein the controlling means controls the speed of unwinding of the printing roll.

3. The device of claim 1 including first means for driving the supply roll, and in which the controlling means controls the speed of the driving means.

4. The device of claim 1 including means for maintaining a desired tension in the web in the absence of power loss of the press.

5. The device of claim 4 wherein the maintaining means controls the rotational speed of the supply roll.

6. The device of claim 1 including means for driving the printing roll, and in which the controlling means drives the supply roll at a speed proportional to the rotational speed of the printing roll.

7. A device for controlling a web in a printing press, comprising:

a supply roll of the web;

a printing roll of the press;

means for detecting a power loss of the press; and means responsive to the detecting means for controlling the tension of the web in the event of the power loss, including first means for driving the supply roll, and in which the controlling means controls the speed of the driving means, and in which the first driving means controls the rotational speed of the supply roll.

8. A device for controlling a web in a printing press, comprising:

a supply roll of the web;

a printing roll of the press;

means for detecting a power loss of the press; and means responsive to the detecting means for controlling the tension of the web in the event of the power loss, including means for detecting a power loss in the press, first drive means for driving the printing roll, second drive means for driving the supply roll, and in which the controlling means comprises means for selectively connecting the supply roll to the first drive means in the presence of a power loss to the press, and connecting the supply roll to the second drive means in the absence of a power loss to the press.

9. The device of claim 8 wherein the controlling means includes a speed changer selectively connected at a desired ratio to the first and second drive means.

10. The device of claim 9 including a clutch for selectively connecting the first drive means to the speed changer.

* * * * *